US007931181B2

(12) United States Patent
Akiba

(10) Patent No.: US 7,931,181 B2
(45) Date of Patent: Apr. 26, 2011

(54) COMBUSTION-TYPE POWER TOOL WITH TRIGGER CONTROL ARRANGEMENTS

(75) Inventor: Yoshitaka Akiba, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/356,106

(22) Filed: Feb. 17, 2006

(65) Prior Publication Data

US 2006/0186166 A1 Aug. 24, 2006

(30) Foreign Application Priority Data

Feb. 18, 2005 (JP) ..... P2005-043279
Feb. 18, 2005 (JP) ..... P2005-043280

(51) Int. Cl.
*B25C 1/08* (2006.01)

(52) U.S. Cl. ..... 227/10; 227/8; 123/46 SC

(58) Field of Classification Search ..... 227/8, 9, 227/10, 11; 123/46 H, 46 R, 46 SC
See application file for complete search history.

(56) References Cited

U.S. PATENT DOCUMENTS

| | | | | | |
|---|---|---|---|---|---|
| 3,949,921 | A | * | 4/1976 | Brack | 227/9 |
| 4,260,092 | A | * | 4/1981 | Austin | 227/8 |
| 4,403,722 | A | | 9/1983 | Nikolich | |
| 4,405,071 | A | * | 9/1983 | Austin | 227/7 |
| 4,483,473 | A | * | 11/1984 | Wagdy | 227/8 |
| 4,483,474 | A | * | 11/1984 | Nikolich | 227/8 |
| 5,174,485 | A | * | 12/1992 | Meyer | 227/8 |
| 5,197,646 | A | | 3/1993 | Nikolich | |
| 5,263,626 | A | * | 11/1993 | Howard et al. | 227/8 |
| 5,485,946 | A | * | 1/1996 | Jankel | 227/8 |
| 5,862,969 | A | | 1/1999 | Lee | |
| 5,909,836 | A | * | 6/1999 | Shkolnikov et al. | 227/8 |
| 6,145,724 | A | * | 11/2000 | Shkolnikov et al. | 227/8 |
| 6,260,519 | B1 | | 7/2001 | Phillips | |
| 6,543,664 | B2 | * | 4/2003 | Wolfberg | 227/8 |
| 6,715,655 | B1 | | 4/2004 | Taylor et al. | |
| 6,974,062 | B2 | * | 12/2005 | Akiba | 227/8 |
| 2005/0173484 | A1 | * | 8/2005 | Moeller et al. | 227/8 |
| 2006/0065691 | A1 | * | 3/2006 | Shima et al. | 227/10 |
| 2006/0185629 | A1 | * | 8/2006 | Nishikawa et al. | 123/46 H |
| 2006/0185630 | A1 | * | 8/2006 | Fujisawa et al. | 123/46 H |
| 2007/0034659 | A1 | * | 2/2007 | Moeller et al. | 227/8 |

FOREIGN PATENT DOCUMENTS

| | | |
|---|---|---|
| EP | 0 123 716 | 11/1987 |
| EP | 0 738 565 | 10/1996 |
| EP | 1 053 834 | 11/2000 |
| EP | 1 391 270 | 2/2004 |
| JP | 64-034753 | 2/1989 |
| JP | 04-048589 | 2/1992 |
| JP | 07-036985 | 2/1995 |

* cited by examiner

*Primary Examiner* — Rinaldi I. Rada
*Assistant Examiner* — Lindsay M. Low
(74) *Attorney, Agent, or Firm* — Antonelli, Terry, Stout & Kraus, LLP.

(57) ABSTRACT

A combustion-type power tool includes a cylinder, a piston, a head, a combustion chamber frame, an ignition unit, a trigger, a control member. The combustion chamber frame is abuttable on the head to provide a combustion chamber in cooperation with the head and the piston. The trigger is operated by a user for driving the fastener into a workpiece. The control member detects that the combustion chamber has been provided and the trigger has been operated, and allows the ignition unit to ignite the combustible gas only when the control member detects that both the combustion chamber has been provided and the trigger has been operated.

4 Claims, 9 Drawing Sheets

COMBUSTION-TYPE POWER TOOL WITH TRIGGER CONTROL ARRANGEMENTS

BACKGROUND OF THE INVENTION

1. Field of the Invention

The present invention relates to a combustion-type power tool, and more particularly, to such power tool capable of driving a fastener such as a nail, an anchor, and a staple into a workpiece.

2. Description of Related Art

In a conventional combustion-type driving tool such as a nail gun, a combustion chamber is formed when a push member is pushed a predetermined distance. Then, a mixture of air and gaseous fuel injected into the combustion chamber is ignited by a spark at an ignition plug to cause gas expansion in the combustion chamber, which in turn causes a linear momentum of a piston. By the movement of the piston, a nail is driven into a workpiece.

Such conventional combustion-type nail gun is described in U.S. Pat. No. 5,197,646. In U.S. Pat. No. 5,197,646, a man cannot turn on a trigger for turning on the ignition plug without pushing a push member.

SUMMARY OF THE INVENTION

However, in Japanese Patent Publication No. H07-36985, even if the push member is not pushed the predetermined distance, that is, the combustion chamber is not formed, a man can turn on the trigger. Thus, in Japanese Patent Publication No. H07-36985, spark and gaseous fuel is consumed in vain.

In view of the above-described drawbacks, it is an objective of the present invention to provide a combustion-type power tool in which the operation for the trigger is not valid if the combustion chamber frame has not been provided.

In order to attain the above and other objects, the present invention provides a combustion-type power tool includes a cylinder, a piston, a head, a combustion chamber frame, an ignition unit, a trigger, and a control member.

The combustion chamber frame is abuttable on the head to provide a combustion chamber in cooperation with the head and the piston. The trigger is operated by a user for driving the fastener into a workpiece. The control member detects that the combustion chamber has been provided and the trigger has been operated, and allows the ignition unit to ignite the combustible gas only when the control member detects that both the combustion chamber has been provided and the trigger has been operated.

Another aspect of the present invention provides a combustion-type power tool includes a striking member, an ignition unit, a trigger and a control member.

A combustion chamber can be provided in the striking member. The striking member provides a fastener with a striking force when the combustion chamber broadens in accordance with combustion of combustible gas injected into the combustion chamber. The ignition unit ignites combustible gas injected into the combustion chamber. The striking member provides the fastener with a striking force when the combustion chamber broadens in accordance with the combustion of the combustible gas injected into the combustion chamber. The trigger is operated by a user for driving the fastener into a workpiece. The control member detects that the combustion chamber has been provided and the trigger has been operated, and allows the ignition unit to ignite the combustible gas only when the control member detects that both the combustion chamber has been provided and the trigger has been operated.

BRIEF DESCRIPTION OF THE DRAWINGS

The above and other objects, features and advantages of the invention will become more apparent from reading the following description of the preferred embodiments taken in connection with the accompanying drawings in which:

FIG. 1 is cut at A-A line;

FIG. 6 is cut at B-B line;

FIG. 9 is cut at C-C line;

FIG. 11 is cut at D-D line.

DETAILED DESCRIPTION OF THE PREFERRED EMBODIMENTS

A combustion-type power tool according to first embodiment of the present invention will be described with reference to FIGS. 1 through 5. The first embodiment pertains to a combustion-type nail gun 1. Throughout the specification, the term "upper" and "lower" are used assuming that the combustion-type nail gun is oriented in a vertical direction.

Figure 1:
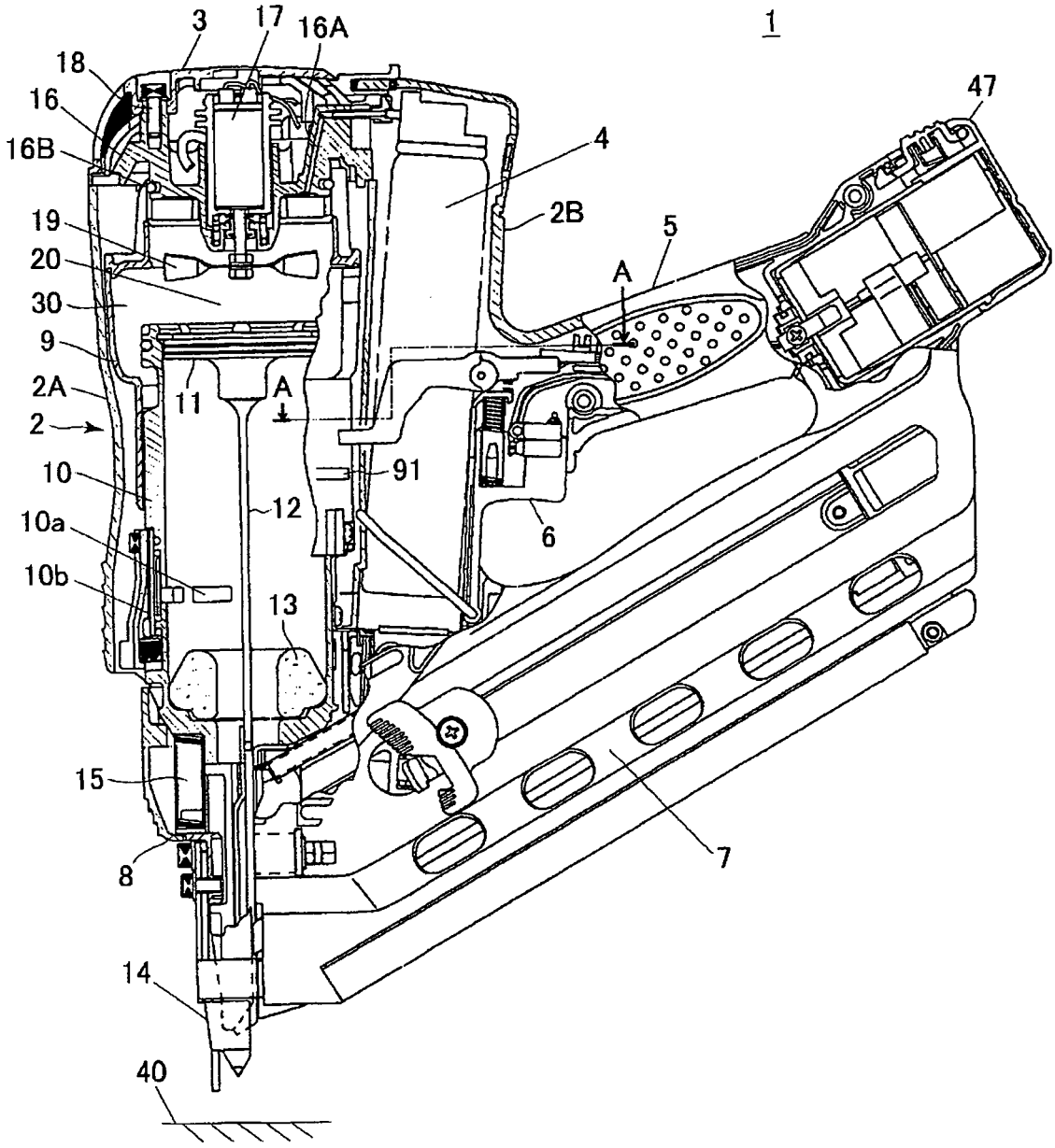
FIG. 1 shows a cross-section view of a combustion-type nail gun.

FIG. 1 shows a cross-section view of a combustion-type nail gun 1. The combustion-type nail gun 1 has a housing 2 constituting an outer frame and including a main housing 2A and a canister housing 2B juxtaposed thereto. An exhaust port (not shown) is formed on main housing 2A. A head cover 3 is mounted on the top of the main housing 2A. An intake port (not shown) is formed on the head cover 3. A gas canister 4 is detachably accommodated in the canister housing 2B. The gas canister 4 contains therein combustible liquidized gas.

A handle 5 extends from a side of the canister housing 2B. The handle 5 has a trigger 6, and accommodates therein a battery (not shown). The trigger 6 will be described later in detail. A magazine 7 and a tail cover 8 are disposed below the housing 2. The magazine 7 is adapted for containing therein nails (not shown), and the tail cover 8 is adapted for feeding the nail in the magazine 7 and setting the nail to a predetermined position.

A combustion chamber frame 9 is provided in the main housing 2A. The combustion chamber frame 9 is movable in the lengthwise direction thereof in the main housing 2A interlockingly in accordance with the movement of a push member 14 (described later), since the lower portion of the combustion chamber frame 9 is connected to the push member 14 via a link member (not shown). The combustion chamber frame 9 is provided with an engage piece 91 extending from an outer surface of the combustion chamber frame 9 in a radial direction of the combustion chamber frame 9. The engage piece 91 will be described later in detail.

A cylinder 10 is fixed to the main housing 2A and has an inner space. An outer surface of the cylinder 10 is in sliding contact with the combustion chamber frame 9. Thus, the cylinder 10 guides movement of the combustion chamber frame 9. An exhaust hole 10*a* is formed on the cylinder 10. An exhaust-gas check valve 10*b* is also provided at the cylinder 10 in order to selectively close the exhaust hole 10*a*.

A piston 11 is slidably and reciprocally provided in the cylinder 10. The piston 11 divides an inner space of the cylinder 10 into an upper space above the piston 11 and a lower space below the piston 11.

A driver blade 12 extends downwards from one surface of the piston 11, the surface being at the cylinder space below the piston 11. The driver blade 12 is positioned coaxially with the nail setting position where the tail cover 8 sets the nail, so that the driver blade 12 can strike against the nail during movement of the piston 11 toward its bottom dead point.

A bumper 13 is provided on the bottom of the cylinder 10. The bumper 13 is made from a resilient material. When the piston 11 moves to its bottom dead point, the piston 11 is abuttable on the bumper 13.

The push member 14 is movably provided at a lower portion of the main housing 2A. The push member 14 has a tip portion adapted to be pressed against a workpiece 40, and has an upper portion associated with the combustion chamber frame 9 via the link member (not shown).

A compression coil spring 15 is interposed between the link member and the cylinder 10 for normally urging the push member 14 in a protruding direction away from the head cover 3. When the housing 2 is pressed toward the workpiece 40 while the push member 14 being in abutment with the workpiece 40 against a biasing force of the compression coil spring 15, an upper portion of the push member 14 is retractable into the main housing 2A.

A cylinder head 16 is secured to the top of the main housing 2A for closing the open top portion of the main housing 2A. A fuel injection passage 16A that allows the combustible gas from the gas canister 4 to pass therethrough is formed the cylinder head 16. One portion of the fuel injection passage 16A is connected to an opened space 30 formed between the upper surface of the piston 11 and the lower surface of the cylinder head 16. Another portion of the fuel injection passage 16A is connected to the gas canister 4. Further, the cylinder head 16 has sealing members 16B that seals a combustion chamber 20 described later while engaging with the combustion chamber frame 9.

A motor 17 and an ignition plug 18 are supported to the cylinder head 16. The ignition plug 18 has an ignition spot exposed to the opened space 30. The ignition plug 18 is ignitable upon manipulation to the trigger 6 and upon the upward movement of the combustion chamber frame 9 in accordance with the pressing of the push member 14 against the workpiece 40. A fan 19 is disposed in the opened space 30, and is connected to the motor 17.

A head switch (not shown) is provided in the main housing 2A for detecting an uppermost stroke portion position of the combustion chamber frame 9 when the push member 14 is pressed against the workpiece 40. The head switch can be turned ON when the push member 14 is elevated to a predetermined position for starting rotation of the motor 17.

When the upper portion of the combustion chamber frame 9 abuts on the cylinder head 16, the lower surface of the cylinder head 16, the inner surface of the combustion chamber frame 9, and the upper surface of the piston 11 define the combustion chamber 20 in combustion.

Figure 2:
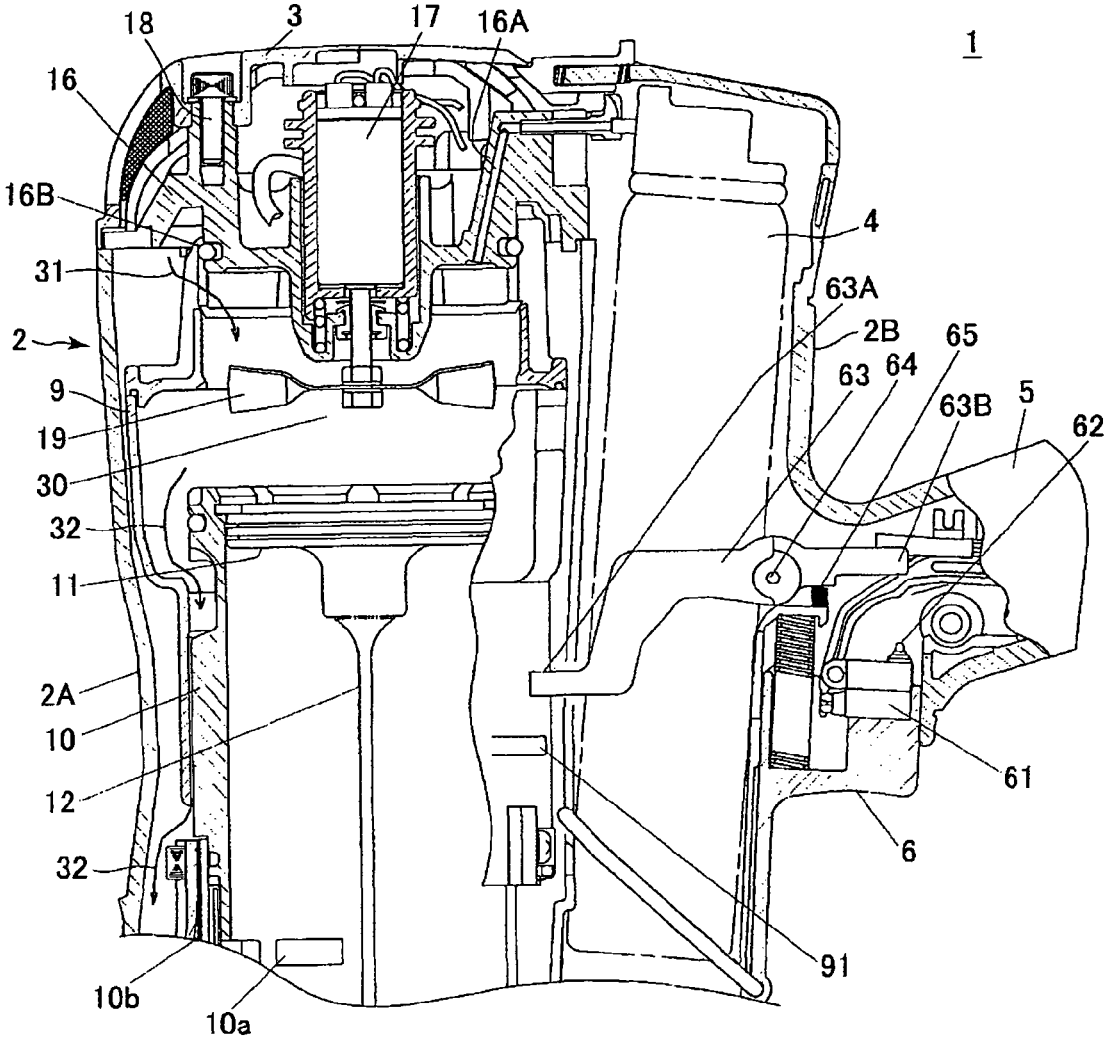
FIG. 2 shows a cross-section view of one part of the combustion-type nail gun before a combustion chamber is formed.

When the upper portion of the combustion chamber frame 9 is separated from the cylinder head 16, a first flow passage 31 as shown in FIG. 2 in communication with an atmosphere is provided between the combustion chamber frame 9 and the cylinder head 16, and a second flow passage 32 in communication with the first flow passage 31 is also provided between the combustion chamber frame 9 and the upper portion of the cylinder 10. These flow passages 31 and 32 allow a combustion gas and a fresh air to pass along the outer peripheral surface of the cylinder 10 for discharging these gas through the exhaust port (not shown) of the main housing 2A. Further, the above-described intake port (not shown) of the head cover 3 is formed for supplying a fresh air into the combustion chamber 20, and the exhaust hole 10*a* is adapted for discharging combustion gas generated in the combustion chamber 20.

In accordance with the movement of the push member 14, the gas canister 4 is tiltingly moved toward the cylinder head 16 by way of a cam mechanism (not shown), and a gauging section (not shown) of the gas canister 4 is pressed. Then, the gas canister 4 injects the combustible liquidized gas into the combustion chamber 20 through the fuel injection passage 16A.

The fan 19 stirs and mixes the air with the combustible gas as long as the combustion chamber frame 9 remains in abutment with the cylinder head 16. Further, after the mixed gas has been ignited, the fan 19 causes turbulent combustion of the air-fuel mixture, thus promoting the combustion of the air-fuel mixture in the combustion chamber 20. Furthermore, the fan 19 performs scavenging such that the exhaust gas in the combustion chamber 20 can be scavenged therefrom and also performs cooling to the combustion chamber frame 9 and the cylinder 10 when the combustion chamber frame 9 moves away from the cylinder head 16.

When the piston 11 moves to its bottom dead point, the tip portion of the driver blade 12 strikes against the nail, and the piston 11 abuts on the bumper 13 and stops. In this case, the bumper 13 absorbs a surplus energy of the piston 11.

Next, operation of the combustion-type nail gun 1 will be described. In the non-operational state of the combustion-type nail gun 1, the push member 14 is biased away from the cylinder head 16 as shown in FIG. 1 by the biasing force of the compression coil spring 15, so that the push member 14 protrudes from the lower portion of the tail cover 8.

Thus, the uppermost portion of the combustion chamber frame 9 is spaced away from the cylinder head 16 as shown in FIG. 2. Further, a part of the combustion chamber frame 9 that defines the combustion chamber 20 is also spaced away from the top portion of the cylinder 10. Hence, the first flow passage 31 and the second flow passage 32 are provided. In this condition, the piston 11 stays at its top dead point in the cylinder 10.

If a user pushes the push member 14 onto the workpiece 40, the push member 14 is moved toward the cylinder head 16 against the biasing force of the compression coil spring 15. At the same time, the combustion chamber frame 9 that is associated with the push member 14 is also moved toward the cylinder head 16, closing the first flow passage 31 and the second flow passage 32. Thus, the sealed combustion chamber 20 is provided.

When the combustion chamber 20 is provided in accordance with the movement of the push member 14, the combustible liquidized gas in the gas canister 4 is injected into the combustion chamber 20 through the fuel injection passage 16A.

Further, when the combustion chamber 20 is provided in accordance with the movement of the push member 14, the head switch is turned ON to energize the motor 17 for starting rotation of the fan 19. Rotation of the fan 19 stirs and mixes the combustible gas with air in the combustion chamber 20.

In this state, if the trigger 6 provided at the handle 5 is turned ON, spark is generated at the ignition plug 18 to ignite the combustible gas. The combusted and expanded gas pushes the piston 11 to its bottom dead point. Therefore, the nail in the tail cover 8 is driven into the workpiece 40 by the driver blade 12.

After the nail driving, the cylinder space above the piston 11 becomes communicated with the exhaust hole 10*a* of the cylinder 10. Thus, the high pressure and high temperature combustion gas is discharged out of the cylinder 10 through the exhaust hole 10*a* to the atmosphere to lower the pressure in the combustion chamber 20. When the pressure of the inner space of the cylinder 10 and the combustion chamber 20 becomes same as the atmospheric pressure, the exhaust-gas check valve 10*b* is closed.

Combustion gas still remaining in the cylinder 10 and the combustion chamber 20 has a high temperature at a phase immediately after the combustion. However, the high temperature can be absorbed into the walls of the cylinder 10 and the combustion chamber frame 9. Absorption of the heat into the cylinder 10 etc. causes rapid cooling to the combustion gas. Thus, the pressure in the sealed space in the cylinder 10 above the piston 11 further drops to less than the atmospheric pressure creating a so-called "thermal vacuum". Accordingly, the piston 11 can be moved back to the initial top dead point position.

Then, the trigger 6 is turned OFF, and the user lifts the combustion-type nail gun 1 from the workpiece 40 for separating the push member 14 from the workpiece 40. As a result, the push member 14 and the combustion chamber frame 9 move away from the cylinder head 16 because of the biasing force of the compression coil spring 15. Thus, the first flow passage 31 and the second flow passage 32 are provided.

In the present embodiment, the fan 19 is configured to keep rotating for a predetermined period of time after the detection of the predetermined position of the combustion chamber frame 9 by the head switch in spite of OFF state of the trigger 6. Thus, fresh air is sucked into the combustion chamber 20 through the intake port formed at the head cover 3 by the rotation of the fan 19. Thus, the combustion gas is urged to flow through the first flow passage 31 and the second flow passage 32, and is discharged to the atmosphere through the exhaust port formed in the main housing 2A. Thus, the combustion chamber 20 is scavenged. Then, the rotation of the fan 19 is stopped to restore an initial stationary state. Thereafter, subsequent nail driving operation can be performed by repeating the above described operation process.

Figure 3:
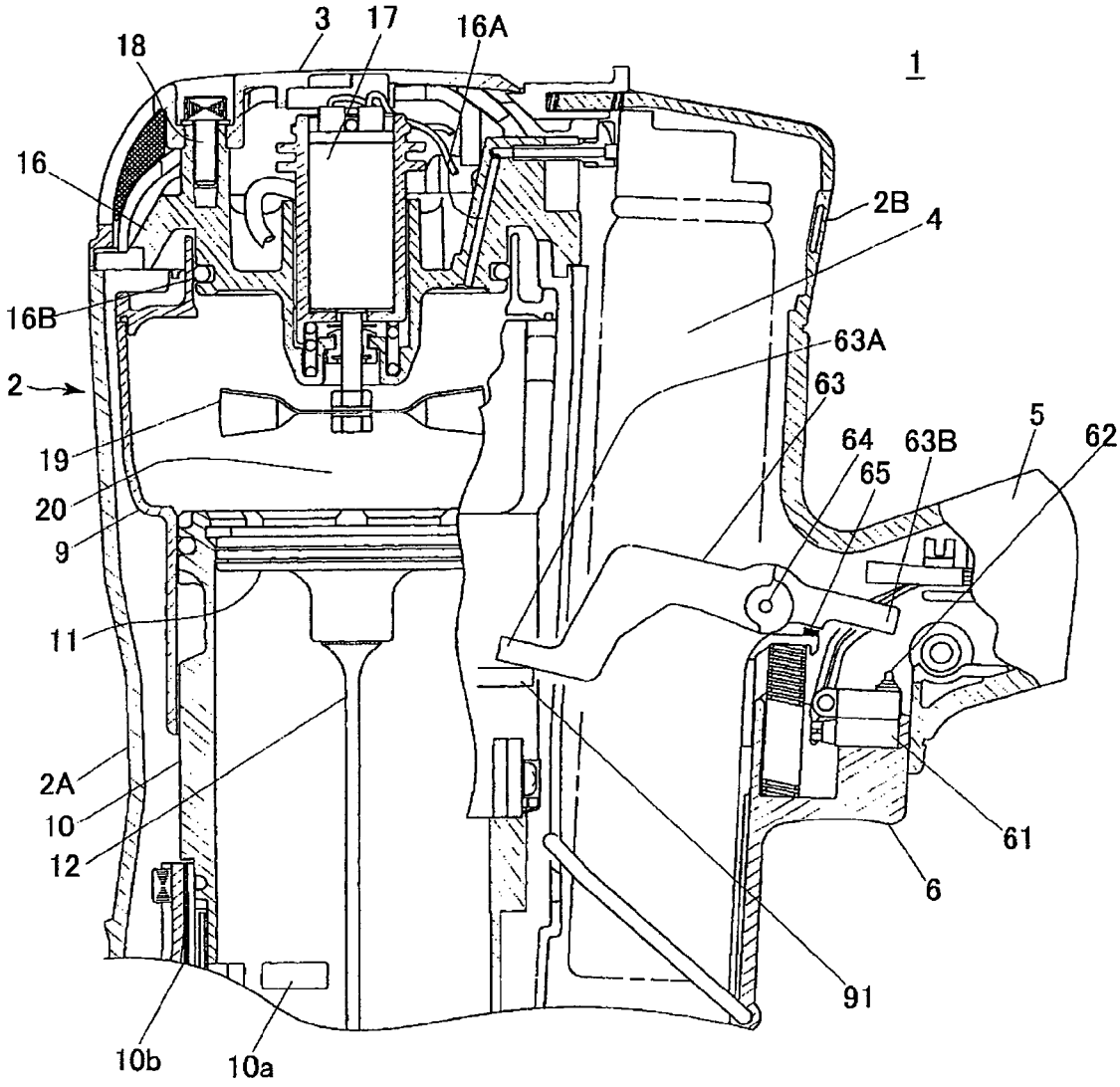
FIG. 3 shows a cross-section view of one part of the combustion-type nail gun after the combustion chamber has been formed.
Figure 4:
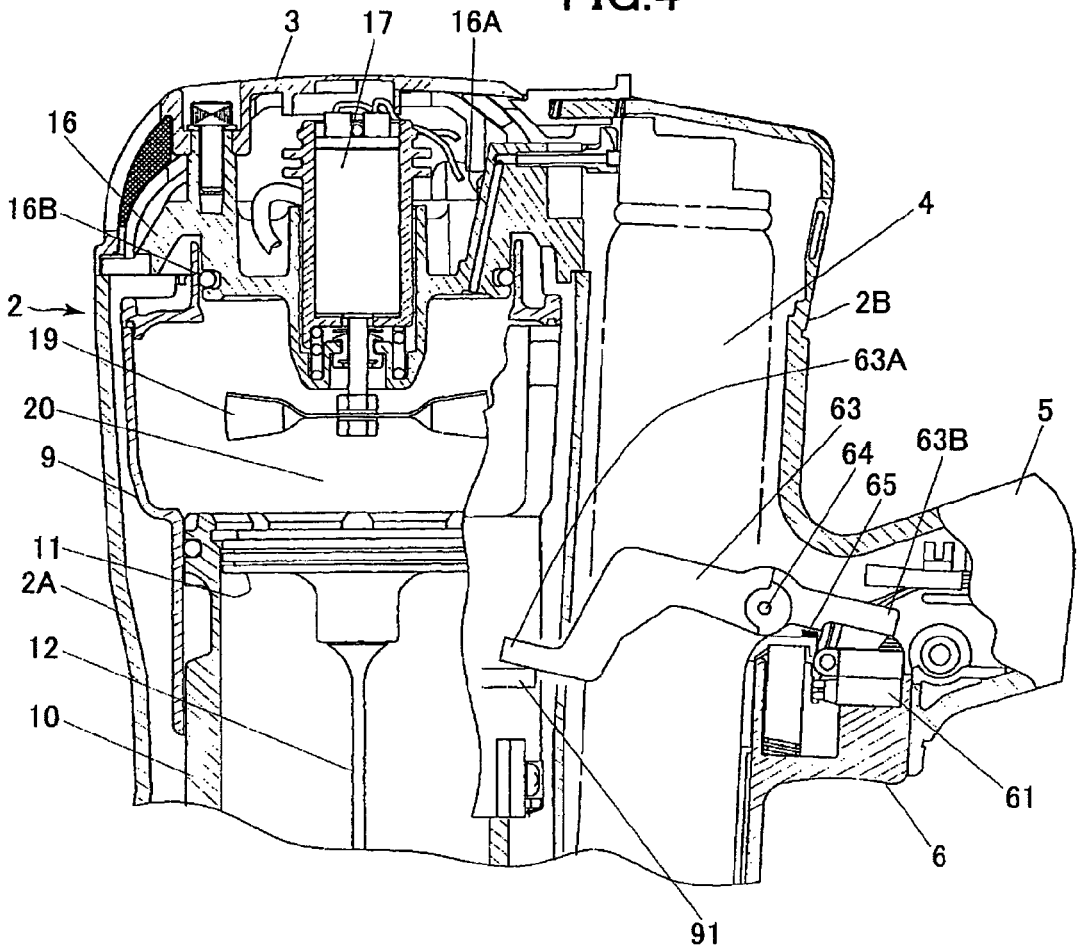
FIG. 4 shows a cross-section view of one part of the combustion-type nail gun when a trigger is turned ON after the combustion chamber has been formed.
Figure 5:
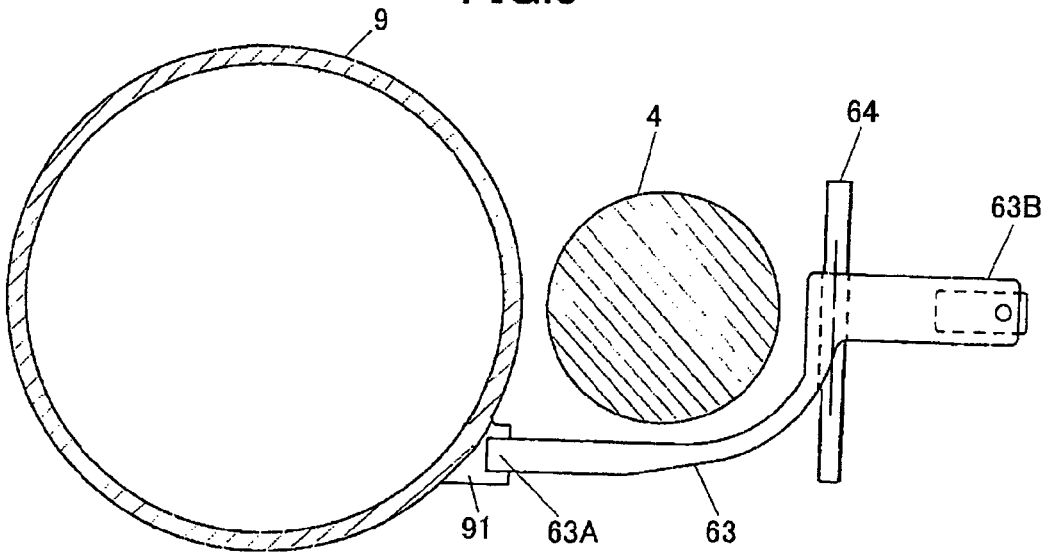
FIG. 5 shows a cross-section view when

Next, the trigger 6 will be described in detail referring to FIGS. 2 through 5. FIG. 2 shows a cross-section view of one part of the combustion-type nail gun 1 before the combustion chamber 20 is formed. FIG. 3 shows a cross-section view of one part of the combustion-type nail gun 1 after the combustion chamber 20 has been formed. FIG. 4 shows a cross-section view of one part of the combustion-type nail gun 1 when the trigger 6 is turned ON after the combustion chamber 20 has been formed. FIG. 5 shows a cross-section view when FIG. 1 is cut at A-A line.

The trigger 6 is provided with a spark switch 61, an actuator 62, a switch lever 63, a support shaft 64 and a spring 65. The spark switch 61 has a junction (not shown) between the spark switch 61 and the ignition plug 18, and is connected to a drive circuit (not shown). The drive circuit drives the ignition plug 18 to spark when the junction is connected. The actuator 62 protrudes from the spark switch 61 upward. When the actuator 62 is pushed, the junction of the spark switch 61 is connected. When the trigger 6 is turned ON, the spark switch 61 and the actuator 62 is moved upward.

The support shaft 64 is fixed to the handle 5. The switch lever 63 is supported to the support shaft 64 rotatably. The switch lever 63 has a first portion 63A positioned at the combustion chamber frame 9 side, and a second portion 63B positioned at the spark switch 61 side. A portion of the switch lever 63 positioned at the combustion chamber frame 9 side than the support shaft 64 has a curved shape as shown in FIG. 5 in order to keep the support shaft 64 from contacting with the gas canister 4.

The first portion 63A is positioned above the engage piece 91 of the combustion chamber frame 9, and engagable with the engage piece 91 when the engage piece 91 is moved upward in accordance with the movement of the push member 14. The second portion 63B is positioned above the actuator 62.

The spring 65 is provided below a portion of the switch lever 63 positioned at the spark switch 61 side than the support shaft 64. Thus, the switch lever 63 is biased in an anticlockwise direction in FIGS. 2 though 4.

Here, a positional relation between the first portion 63A and the actuator 62 is set so that a bottommost of the second portion 63B contacts with a topmost portion of the actuator 62 only when the second portion 63B is moved downward in accordance with the rotation of the switch lever 63 and the actuator 62 is moved upward in accordance with the ON of the trigger 6 as shown FIG. 4.

Accordingly, when the combustion chamber 20 has not formed, the spark switch 63 is not turned ON even if the trigger 6 is turned ON. Thus, the combustion-type nail gun 1 can prevents the ignition plug 18 from sparking in the opened space 30 in vain.

Note that the push member 14 may be turned ON after the trigger 6 is turned ON, though the trigger 6 is turned ON after the push member 14 is turned ON in the present embodiment. Thus, it is possible to drive the nail into the workpiece 40 regardless of order of operating the push member 14 and trigger 6.

Next, a combustion-type power tool according to second embodiment of the present invention will be described with reference to FIGS. 6 through 12 wherein like parts and components as the first embodiment are designated by the same reference numerals to avoid duplicating description and description with respect the like parts and components as the first embodiment are omitted. The second embodiment pertains to a combustion-type nail gun 100. The combustion-type nail gun 100 is provided with a trigger 60 instead of the trigger 6 of the first embodiment.

Figure 6:
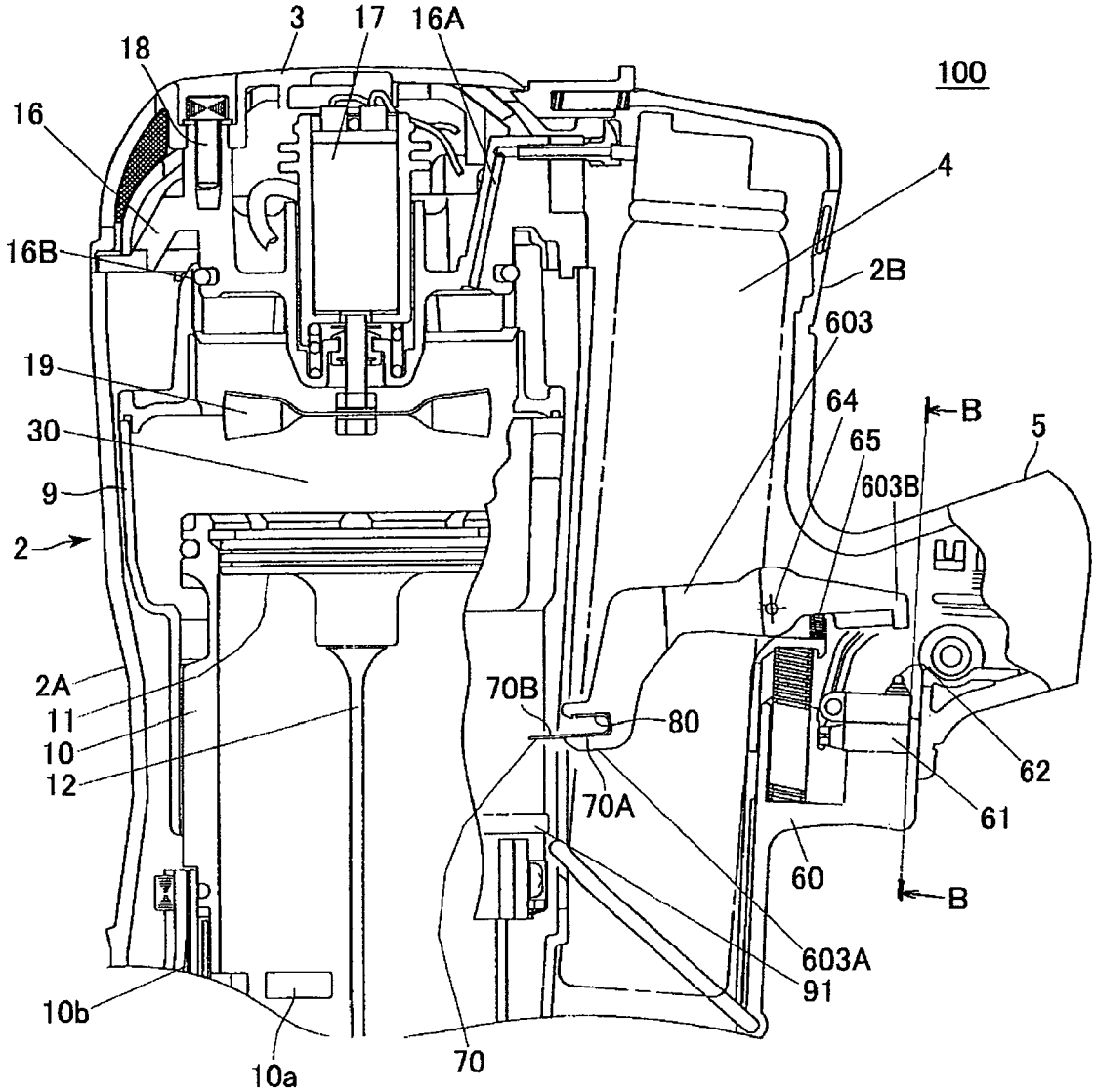
FIG. 6 shows a cross-section view of one part of a combustion-type nail gun before a combustion chamber has been formed.
Figure 7:
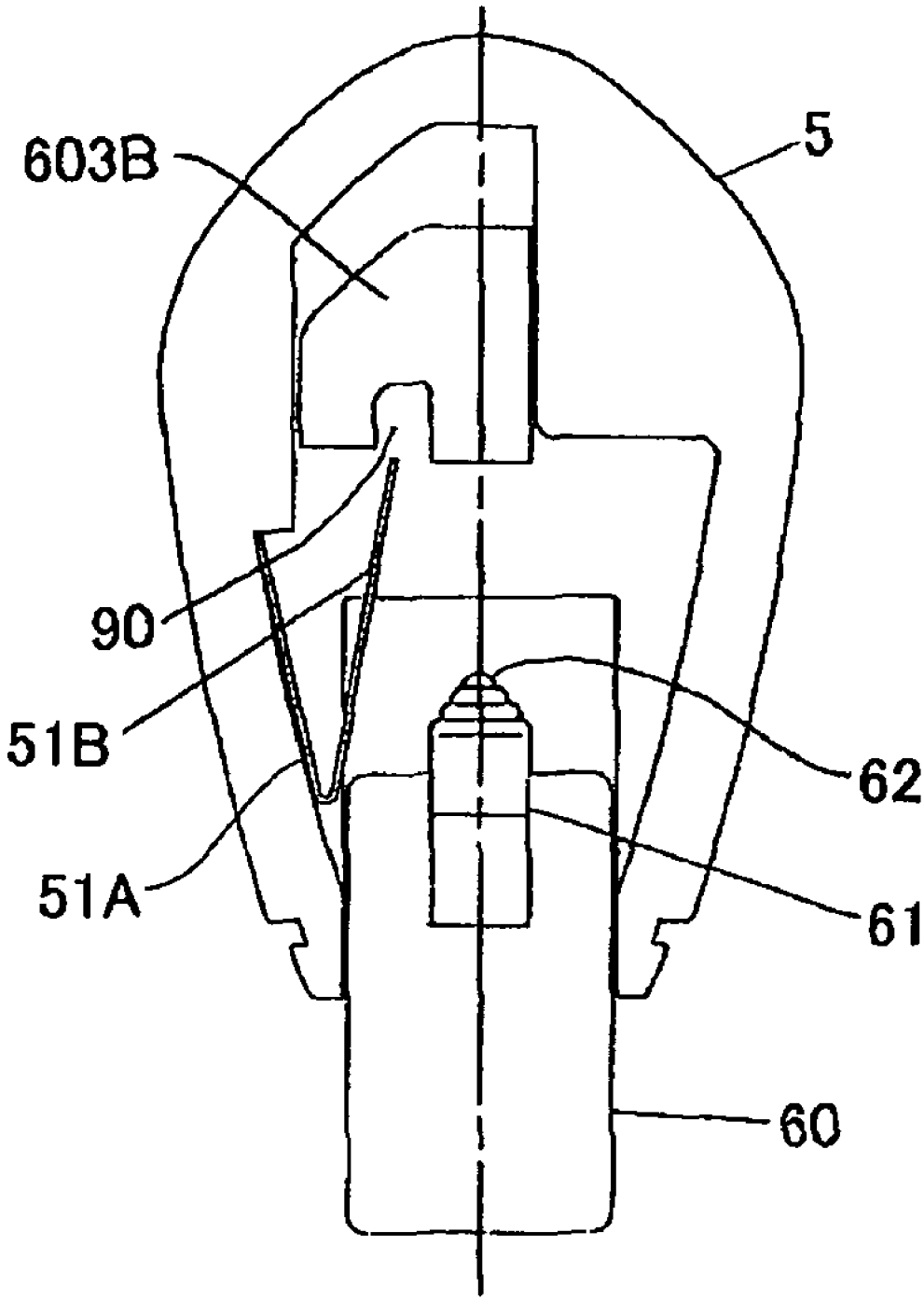
FIG. 7 shows a cross-section view when

FIG. 6 shows a cross-section view of one part of the combustion-type nail gun 100 before the combustion chamber 20 has been formed. FIG. 7 shows a cross-section view when FIG. 6 is cut at B-B line. The trigger 60 is provided with a spark switch 61, an actuator 62, a switch lever 603, a support shaft 64 and a spring 65. Description with respect to the spark switch 61, the actuator 62, the support shaft 64 and the spring 65 is omitted, since they have same constructs as the first embodiment respectively.

The switch lever 603 has a first portion 603A positioned at the combustion chamber frame 9 side, a second portion 603B positioned at the spark switch 601 side, and a plate spring 70. The first portion 603A is not positioned above the engage piece 91 of the combustion chamber frame 9. A U-shape groove 80 is formed in the first portion 603A. The plate spring 70 has a U-shape portion 70A and an extending portion 70B that extends from one portion of the U-shape portion 70A. The U-shape portion 70A is fit into the U-shape hole 80. When the U-shape portion 70A is fit into the U-shape hole 70, the extending portion 70B is positioned above the engage piece 91, and engagable with the engage piece 91 when the engage piece 91 is moved upward in accordance with the movement of the push member 14.

The second portion 603B is positioned above the actuator 62. An groove 90 is formed in the 603B. The handle 5 includes a restrain member formed as a V-shape plate spring therein as shown in FIG. 7. The V-shape spring has a fixed portion 51A fixed to the inner surface of the handle 5 and a free portion 51B opposite to the groove 90.

Figure 8:
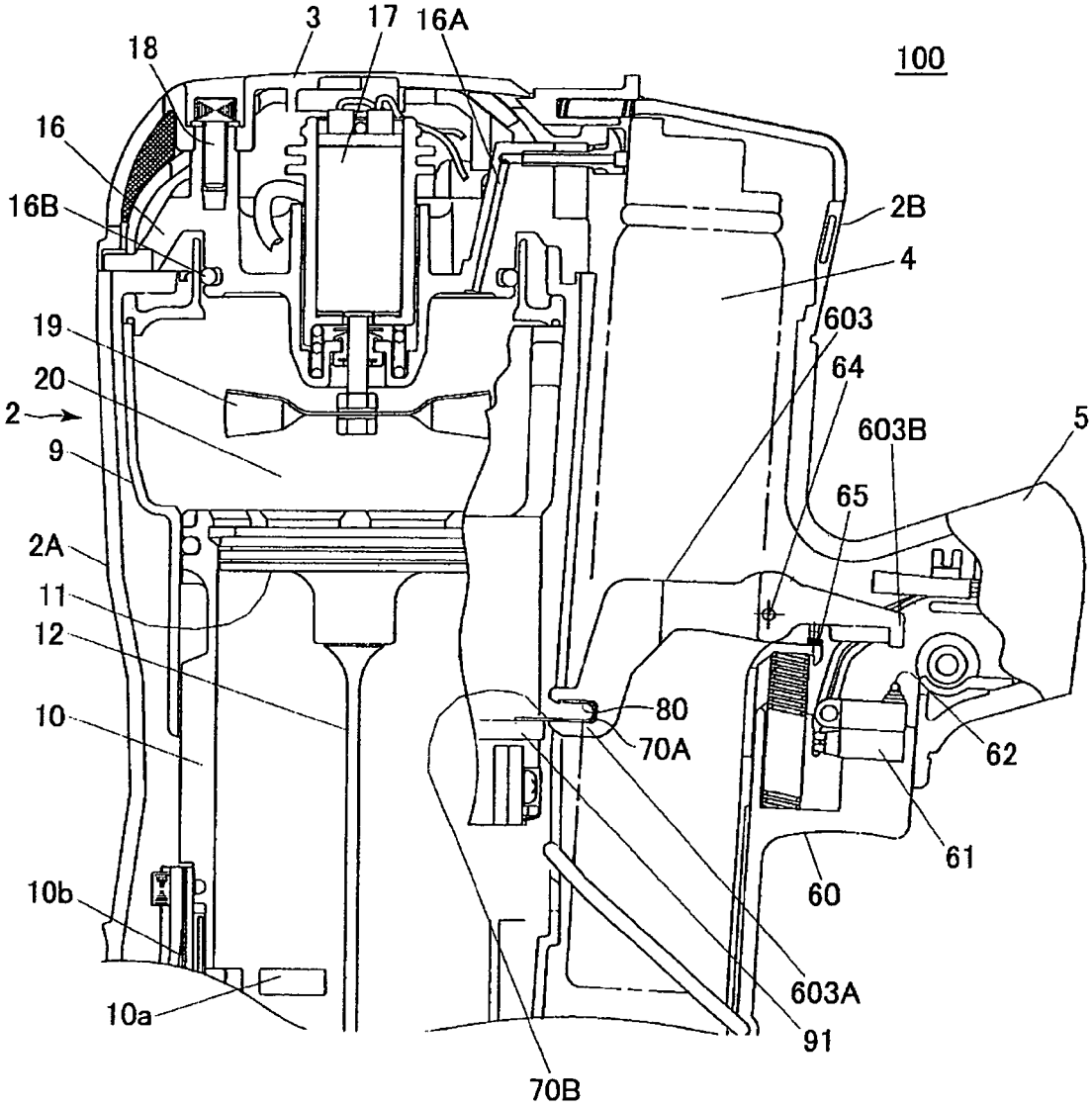
FIG. 8 shows a cross-section view of one part of the combustion-type nail gun when the combustion chamber has been formed.
Figure 9:
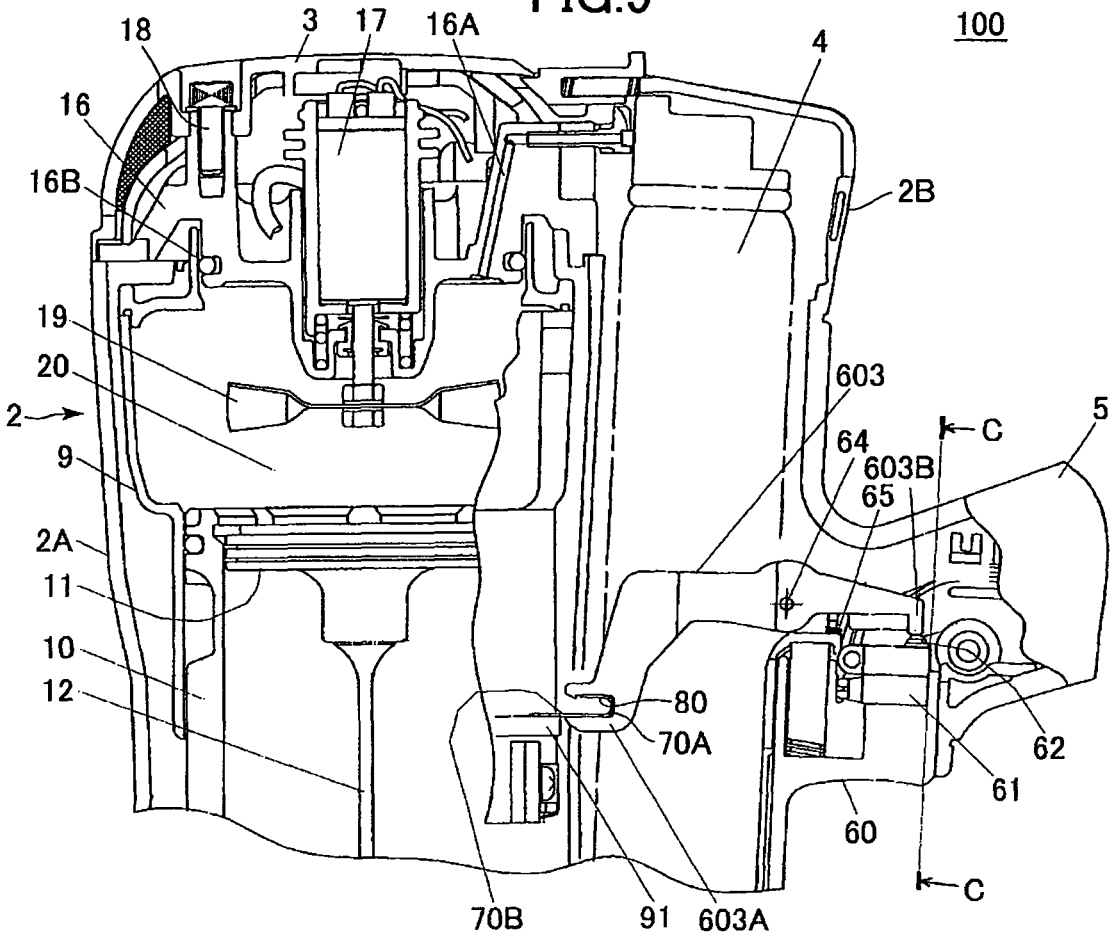
FIG. 9 shows a cross-section view of one part of the combustion-type nail gun when a trigger is turned ON after the combustion chamber has been formed.
Figure 10:
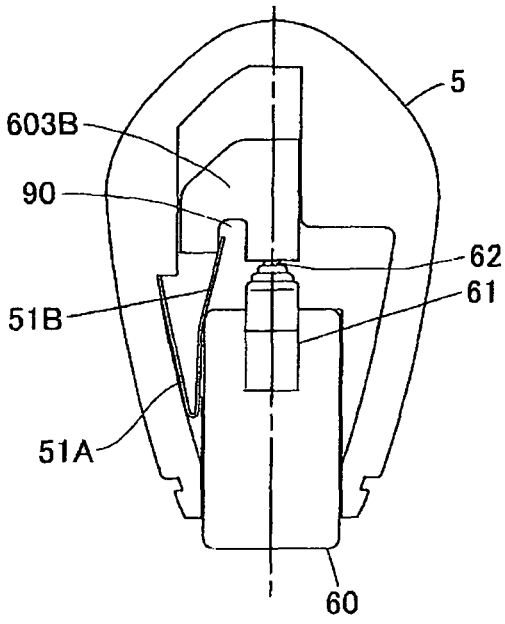
FIG. 10 shows a cross-section view when

FIG. 8 shows a cross-section view of one part of the combustion-type nail gun 100 when the combustion chamber 20 has been formed. FIG. 9 shows a cross-section view of one part of the combustion-type nail gun 100 when the trigger 60 is turned ON after the combustion chamber 20 has been formed. FIG. 10 shows a cross-section view when FIG. 9 is cut at C-C line.

In the states as shown in FIGS. 8 through 10, the trigger 60 is not turned ON, that is, the trigger 60 is not moved upward though the second portion 603B is moved downward. Accordingly, in the state of FIG. 9, the free portion 51B is inserted into the groove 90 in accordance with the movement of the trigger 60 downward. Then, if the trigger 60 is turned ON, that is, the trigger 60 is moved upward, the free portion 51B deforms while keeping being inserted into the groove 90 as shown in FIG. 10. Thus, the second portion 63B contacts with the actuator 62 in accordance with the movement of the trigger 60 upward when the trigger 60 is turned ON.

Figure 11:
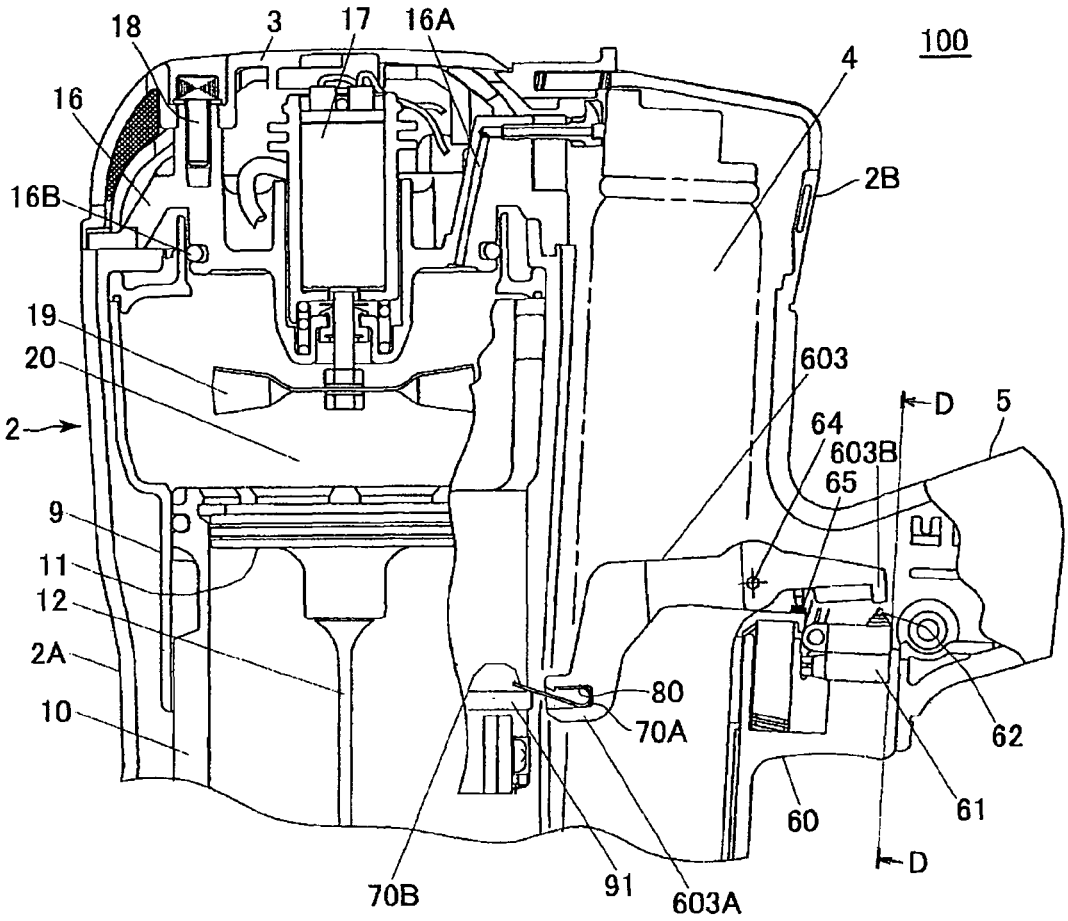
FIG. 11 shows a cross-section view of one part of the combustion-type nail gun when the trigger is turned ON before the combustion chamber has been formed.
Figure 12:
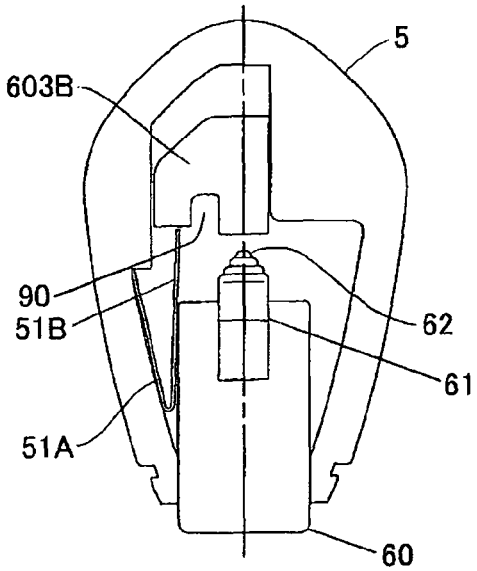
FIG. 12 shows a cross-section view when

FIG. 11 shows a cross-section view of one part of the combustion-type nail gun 100 when the trigger 60 is turned ON before the combustion chamber 20 has been formed. FIG. 12 shows a cross-section view when FIG. 11 is cut at D-D line.

When the trigger 60 is turned ON before the combustion chamber 20 has been formed, the free portion 51B moves a position not opposite to the groove 90 in accordance with the movement of the trigger 60 upward as shown in FIG. 12. Therefore, the free portion 51B does not inserted into the groove 90 even if the second portion 603B is moved downward in accordance with the movement of the push member 14.

At this time, the switch lever 603 cannot rotates, since the free portion 51B obstructs the rotation of the switch lever 603. Therefore, a great impact is applied to the first portion 603A from the engage piece 91. However, the U-shape portion 70A deforms in accordance with the movement of the engage piece 91 upward while keeping the extending portion 70B contacting with the engage piece 91 as shown in FIG. 11. Since the plate spring 70 reduces an impact applied to the first portion 603A, it prevents the first portion 603A and the engage piece 91 from damaging.

Accordingly, when the combustion chamber 20 has not formed, the spark switch 63 is not turned ON even if the trigger 6 is turned ON. Thus, the combustion-type nail gun 100 can prevents the ignition plug 18 from sparking in the opened space 30 in vain.

While the invention has been described in detail and with reference to specific embodiments thereof, it would be apparent to those skilled in the art that various changes and modification may be made therein without departing from the scope of the invention.

For example, the present invention is not limited to the nail gun but is available for any kind of power tools in which a combustion chamber and a piston are provided, and as long as expansion of gas as a result of combustion of air-fuel mixture in the combustion chamber causes reciprocal motion of the piston.

What is claimed is:

1. A combustion-type power tool comprising a housing;

a cylinder disposed in the housing and defining an axial direction;

a piston slidably disposed in the cylinder and reciprocally movable in the axial direction;

a head opposed to the piston;

a combustion chamber frame movable in the axial direction, the combustion chamber frame being abuttable on the head to seal a combustion chamber defined by the combustion chamber frame in cooperation with the head and the piston;

an ignition unit that ignites combustible gas injected into the combustion chamber;

a trigger that is operated by a user for driving a fastener into a workpiece, the trigger movable in the axial direction;

a lever having one end portion engageable with the combustion chamber frame and an other end portion located above the trigger, the lever being rotatable via engagement with the combustion chamber frame so that the other end portion moves between a first position and a second position which is closer than the first position from the trigger; and a restrain member disposed between the trigger and the housing and extending toward the other end portion of the lever, the restrain member being in contact with the other end portion to prevent the trigger from moving into contact with the other end portion of the lever when the trigger is depressed before the other end portion takes the second position.

2. The combustion-type power tool according to claim 1, wherein the trigger includes a spark switch movable via trigger movement and is turned on when the trigger contacts with the other end portion of the lever.

3. The combustion-type power tool according to claim 1, wherein the restrain member comprises a V-shaped plate spring disposed between the trigger and the housing.

4. The combustion-type power tool according to claim 1, wherein the other end portion of the lever includes a first surface and a second surface located closer than the first surface from the trigger, and wherein the restrain member contacts with the first surface when the trigger is depressed after the other end portion takes the second position and contacts with the second surface when the trigger is depressed before the other end portion takes the second position.

* * * * *